United States Patent [19]

Collins

[11] 4,187,575

[45] Feb. 12, 1980

[54] BACK WASH-MASSAGE-SCRUBBER

[76] Inventor: Robert Collins, 144 Shaw St., Garfield, N.J. 07026

[21] Appl. No.: 948,467

[22] Filed: Oct. 4, 1978

Related U.S. Application Data

[63] Continuation-in-part of Ser. No. 866,250, Jan. 3, 1976, abandoned.

[51] Int. Cl.[2] ..... A47K 7/02

[52] U.S. Cl. ..... 15/222; 15/227; 128/63; 128/65; 401/8

[58] Field of Search ..... 15/104.93, 118, 222, 15/227; 128/63, 65; 401/8; D28/63

[56] References Cited

U.S. PATENT DOCUMENTS

| | | | |
|---|---|---|---|
| 1,404,401 | 1/1922 | Novick | 401/8 |
| 1,473,315 | 11/1923 | Poirier | 15/222 |
| 1,521,935 | 1/1925 | Elwell | 15/227 |
| 2,154,831 | 4/1939 | Booharin | 15/222 X |

FOREIGN PATENT DOCUMENTS

| | | | |
|---|---|---|---|
| 2625 | 2/1911 | United Kingdom | 15/227 |

*Primary Examiner*—Billy J. Wilhite
*Attorney, Agent, or Firm*—David A. Jackson

[57] ABSTRACT

A combination hand washer and back scrubber, comprising an elongated strip of fabric, having two lateral edges, transverse, expansible strips attached to a first side of said fabric strip, each transverse strip extending substantially the entire width of said fabric strip, said transverse, expansible strips including sponge strips and abrasive strips aligned on said first side in an alternating manner, a water absorbent strip attached to an opposite second side of said fabric strip, said water absorbent strip being non-abrasive to skin, and a transverse elastic hand strap of elongated dimension, attached at opposite ends to said respective lateral edges of said fabric strip at approximately the midpoints thereof to form a loop for retaining said fabric strip in a folded position and for allowing the hand of a person to fit within said loop to use said combination hand washer and back scrubber as a wash cloth.

7 Claims, 5 Drawing Figures

BACK WASH-MASSAGE-SCRUBBER

CROSS-REFERENCE TO RELATED APPLICATION

This application is a Continuation-In-Part of my copending U.S. Patent Application, Ser. No. 866,250, filed Jan. 3, 1976, now abandoned.

BACKGROUND OF THE INVENTION (1) Field of the Invention

The present invention relates to a combination hand washer and back scrubber. More particularly, the present invention relates to a combination hand washer and back scrubber to be employed in the cleansing of the body of a person.

(2) Description of the Prior Art

Many devices are known in the prior art for cleansing the body of a person and more particularly, the back of a person during bathing. These devices usually take on the configuration of an elongated strip of fabric having a sponge material on at least one side. For example, see U.S. Pat. Nos. 1,367,747 to Keplinger and 2,154,831 to Booharin. These patents disclose an elongated strip of fabric having transverse sponge strips on one side, the sponge strips of Booharin being substantially perpendicular to the lateral edges of the elongated strip and the sponge strips of the Keplinger being askew to the lateral edges of the elongated strip.

Further, other prior art devices utilize, alone or in conjunction with the sponge members, various types of abrasive members. U.S. Pat. No. 2,154,831 to Booharin discloses alternating abrasive and sponge members, the abrasive members being the the form of comb-like projections, hemispherical members or cylindrical members. Other patent utilize brushlike abrasive members alone on one side of an elongated strip of fabric. For example, see U.S. Pat. Nos. 799,799 to Moseley, 1,473,315 to Poiriea and Swiss Pat. No. 307,131 to Wiesendanger.

Lastly, only one patent was found which utilizes a transverse elastic hand strap attached to the lateral edges of the elongated strip in order that a user can place his hand therein for using the back scrubber as a hand wash cloth or brush. U.S. Pat. No. 1,473,315 provides a hand strap for such a use. This patent discloses a bath and massage brush having bristles attached to one side of a short fabric strip, the ends of the fabric strip having snaps thereon. When the device is intended to be utilized as a back scrubber, extension strips, having corresponding snaps on one end and rings at their opposite ends are attached to the ends of the fabric strip by means of snaps. When the device is intended to be utilized as a hand washer, the extension straps are removed from the fabric strip and the ends of the fabric strip are folded around under the hand strap and secured to one another by means of the snap fasteners.

SUMMARY OF THE INVENTION

In accordance with the present invention, a combination hand washer and back scrubber is provided, comprising an elongated strip of fabric having two lateral edges and transverse, expansible strips attached to a first side of the fabric strip, each strip extending substantially the entire width of the fabric strip, the expansible strips including transverse, sponge strips and transverse, abrasive strips aligned on the first side of the fabric strip in an alternating manner.

The invention also includes a water absorbent strip attached to an opposite second side of the fabric strip, the water absorbent strip being non-abrasive to skin.

Lastly, the present invention includes a transverse elastic hand strap of an elongated dimension, attached at opposite ends to the respective lateral edges of the fabric strip at approximately the midpoints thereof to form a loop for retaining the fabric strip in a folded position and for allowing the hand of a person to fit within the loop to use the combination hand washer and back scrubber as a wash cloth.

DETAILED DESCRIPTION OF THE INVENTION

Figure 1:
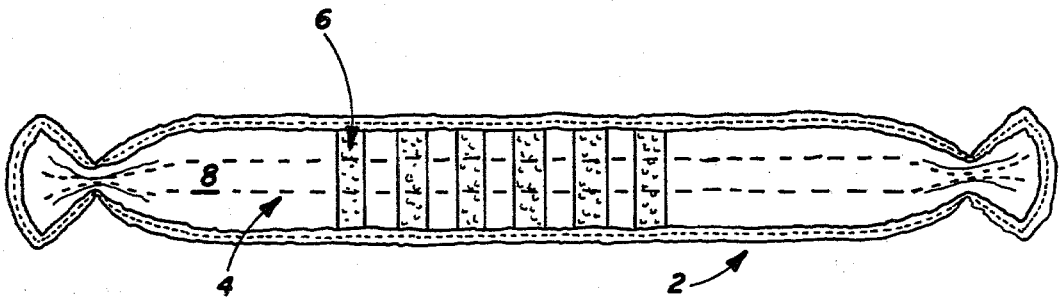
FIG. 1 is a top plan view of a first side of the present invention used as a back scrubber.

Referring to the Figures wherein like numerals represent like parts, and more particularly, to FIG. 1, a combination hand washer and back scrubber 2 is provided, comprising an elongated strip of fabric 4, transverse, expansible scrubber strips 6 attached to a first side 8 of fabric strip 4, a water absorbent strip 10 attached to the opposite second side of fabric strip 4, and a transverse elastic hand strap 12 attached to fabric strip 4.

Fabric strip 4 is of an elongated dimension, and preferably of a rectangular configuration having lateral and substantially parallel edges 14 along the length thereof. Fabric strip 4 may be made from any suitable and durable material such as canvas.

Figure 3:
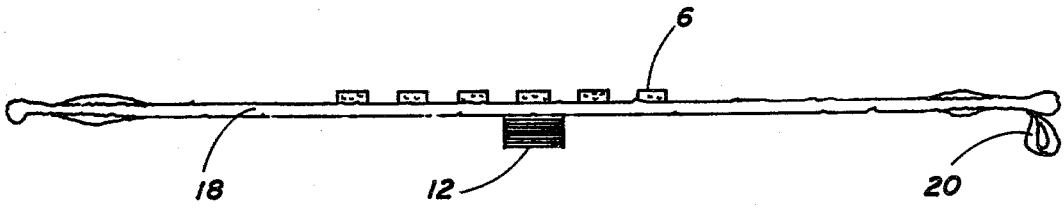
FIG. 3 is a side plan view of the present invention used as a back scrubber.
Figure 4:
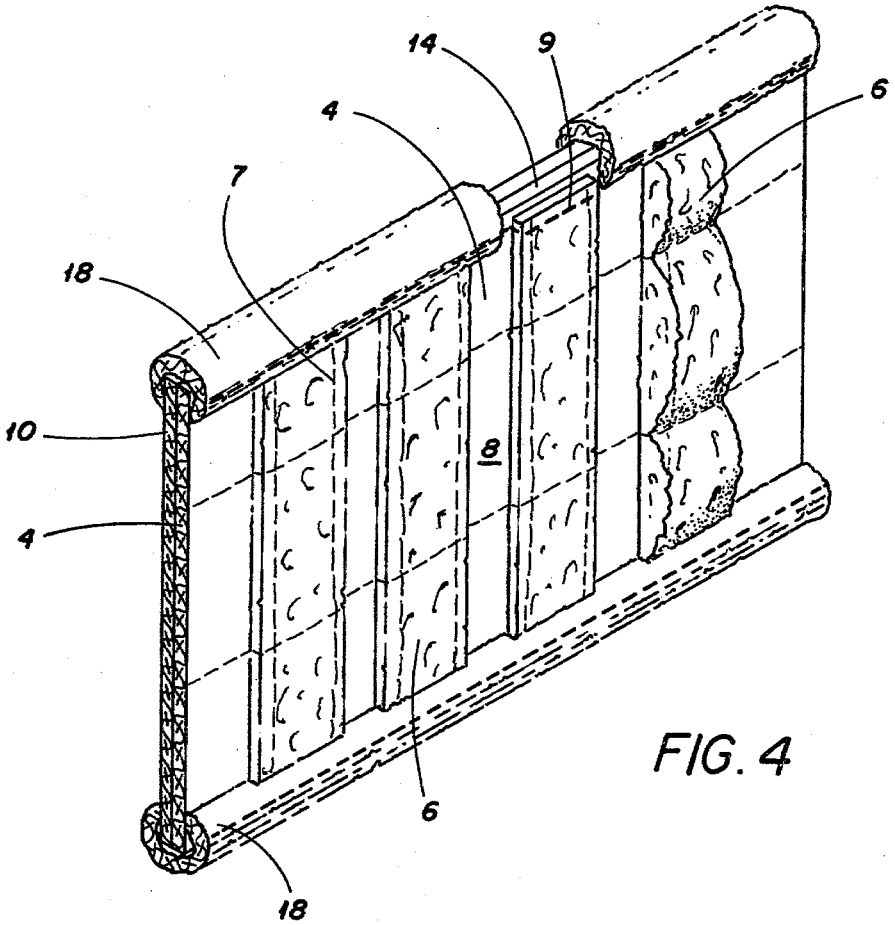
FIG. 4 is a perspective, fragmentary view of the present invention.

As shown in FIGS. 1, 3 and 4, transverse, expansible strips 6 are attached to a first side 8 of fabric strip 4. Expansible strips 6 are preferably of an elongated or rectangular dimension, each strip 6 extending substantially the entire width of fabric strip 4 and preferably situated, as shown in FIGS. 1 and 4, at substantially right angles to lateral edges 14 of fabric strip 4. Each expansible strip 6 may be attached to fabric strip 4 by any suitable means. For example, expansible strips 6 are shown in FIG. 4 as being sewn around the perimeter thereof along longitudinal perimeter lines 7 and end perimeter lines 9, and are also sewn transversely thereacross to divide strips 6 into three segments.

Figure 5:
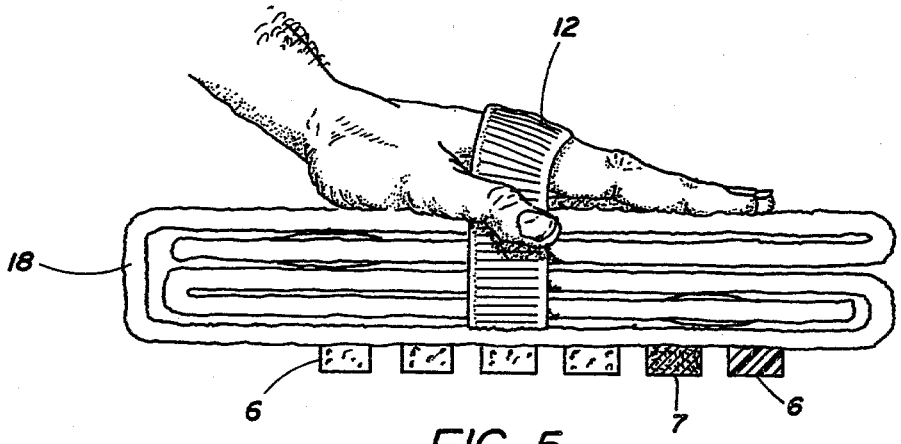
FIG. 5 is a side plan view partly in section of the present invention folded up to be used as a hand washer.

Expansible strips 6 include transverse, expansible, soapand-water-retaining strips and transverse, expansible abrasive strips. Referring now to FIG. 5, soap-and-water-retaining strips 6 may be made from any suitable absorptive material such as an appropriate sponge rubber, but must be capable of expanding or rising when placed in a liquid. The abrasive strips 7 include an under layer of sponge rubber identical to the soap-and-water-retaining strips and also include a thin, non-expansible upper abrasive layer thereon. Any suitable abrasive layer may be utilized with the present invention, including, but not limited to, nylon yarns under the trademark "Permalon", burlap, a netting or fabric such as coconut coir, a sisal or jute fabric, or a combination material such as 45% polyethylene, 15% polyamide, 15% cotton, and a 25% viscose material. The abrasive strips would be the same dimensions as the sponge rubber material and would be attached sewn thereto.

It has been found in a preferred embodiment, that an optimum size for expansible strips 6 would be 3½ inches long and 1¼ inches wide on a 4 inch wide fabric strip 4, with a sponge rubber material that rises to approximately ⅝ inches when wet. Further, an optimum number of expansible strips 6 may be six, the strips being arranged in a mixed manner in the order of a soap-and-water-retaining strip, an abrasive strip, two soap-and-water-retaining strips, an abrasive strip, and a soap-and-water-retaining strip, there being a 1½ inch space between the strips.

Figure 2:
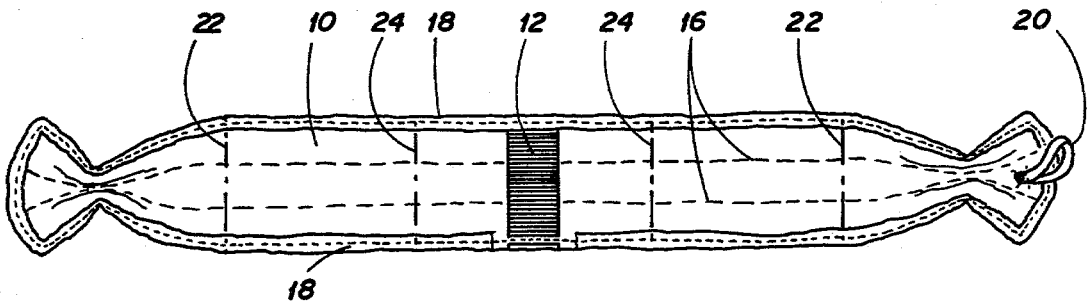
FIG. 2 is a bottom plan view of a second side of the present invention used as a back scrubber.

On the opposite side of fabric strip 4 is attached a water absorbent strip 10 of any suitable material that is non-abrasive to skin, such as terrycloth. Water absorbent strip 10 is attached to fabric strip 4 by any suitable means. For example, as shown in FIG. 2, water absorbent strip 10 may include longitudinal sew lines 16 which divides strip 10 into three sections. These sew lines 16 would also provide for the dividing of expansible strips 6 into three sections as discussed previously. Water absorbent strip 10 may include any suitable design on the back thereof for aesthetic purposes or for advertisement purposes.

Further, a binder strip 18 is preferably provided around the periphery of fabric strip 4 for sewing the end edges of expansible strips 6 and periphery of absorbent strip 10 to fabric strip 4. In this manner, binder strip 18 is provided along the perimeter of fabric strip 4 and extends approximately ½ inch on both sides of fabric strip 4 where it is sewn onto fabric strip 4, thereby binding the periphery of water absorbent strip 10 with the periphery of fabric strip 4 and edges of expansible strips 6 with fabric strip 4. Binder strip 18 may be made from any suitable material but is preferably made of a canvas and twill material.

After binder strip 18 is sewn onto fabric strip 4, the longitudinal ends of fabric strip 4 are pinch-pleated in order to provide easy holding of fabric strip 4 when the apparatus is utilized as a back scrubber.

In addition, a hook 20 can be attached to one end of fabric strip 4, as shown in FIG. 2, for hanging the combination hand washer and back scrubber 2 after use.

Lastly, the present invention also includes a transverse elastic hand strap 12 of an elongated dimension which is attached at its opposite ends to lateral edges 14 of a fabric strip 4 on the side opposite expansible strips 6 so as to be disposed over absorbent strip 10. Hand strap 12 is preferably attached near the longitudinal midpoint of fabric strip 4 and at right angles to lateral edges 14 of fabric strip 4. The purpose of elastic hand strap 12 is to retain fabric strip 4 in a folded position and to allow the hand of a person to fit within the loop formed by the attachment of hand strap 12 to use the combination hand washer and back scrubber 2 as a wash cloth. The provision of a hand strap to perform both of the above functions is believed to be particularly unique and unappreciated by the known prior art.

Utilizing hand strap 12, and referring to FIG. 2, fabric strip 4 is first folded over along imaginary lines 22 near the ends thereof. The folded sections are then folded along imaginary lines 24 and slipped under hand strap 12. The resulting configuration is shown in FIG. 5. The user then slips his hand under hand strap 12 and over fabric strip 4, as shown in FIG. 5, to wash his body and use the device as a wash cloth. Hand strap 12 may be made from any suitable material but is preferably made from a ribbed elastic material. In a preferred embodiment, the dimensions for hand strap 12 may be 6 inches long and 1¼ inches wide.

In constructing the present invention, the user first places expansible strips 6 in the desired positions on fabric strip 4 and sews strips 6 thereon along longitudinal perimeter lines 7. Water absorbent strip 10 is then sewn on the opposite side of fabric strip 4 along longitudinal sew lines 16. In this manner, longitudinal sew lines 16 also divide expansible strips 6 into three sections. Elastic hand strap 12 is then placed on top of water absorbent strip 10 and fabric strip 4 in position thereon as previously discussed and as shown in FIG. 2. Binder strip 18 is then placed along the periphery of fabric strip 4, overlapping the periphery of absorbent strip 10, the end edges of expansible strips 6 and the end edges of hand strap 12. Binder strip 18 is then sewn along the periphery of fabric strip 4, thus binding the periphery of absorbent strip 10, the end edges of expansible strip 6 and the end edges of hand strap 12 to fabric strip 4. The longitudinal ends of fabric strip 4, including absorbent strip 10 and binder strip 18 sewn thereon, are then pinch-pleated. A hook 20 is then attached to one end of fabric strip 4.

It is to be understood that the invention is not limited to the illustrations described and shown herein, which are deemed to be merely illustrative of the best modes of carrying out the invention, and which are suitable of modification form, size, arrangement of parts and details of operation. The invention rather is intended to encompass all such modifications which are in the spirit and scope as defined by the claims.

What is claimed is:

1. A combination hand washer and back scrubber, comprising:

an elongated strip of fabric, having two lateral edges;

transverse, expansible scrubber strips comprising transverse, expansible soap-and-water retaining strips and transverse abrasive strips, attached to a first side of said fabric strip, each of said transverse strips extending substantially the entire width of said fabric strip;

a water absorbent strip attached to an opposite second side of said fabric strip, said water absorbent strip being non-abrasive to skin; and a transverse elastic hand strap of an elongated dimension attached at its opposite ends to said respective lateral edges on said fabric strip at approximately the midpoints thereof to form a loop for retaining said fabric strip in a folded position and for allowing the hand of a person to fit within said loop to use said combination hand washer and back scrubber as a wash cloth.

2. The combination hand washer and back scrubber of claim 1 wherein said soap-and-water-retaining strips are made from an absorptive sponge material.

3. The combination hand washer and back scrubber of claim 1 wherein said soap-and-water-retaining strips and abrasive strips are aligned on said first side of said fabric strip in a mixed manner.

4. The combination hand washer and back scrubber of claim 1 wherein said lateral edges of said fabric strip are substantially parallel to each other and said expansible strips are attached to said first side of said fabric strip at substantially right angles to said lateral edges.

5. The combination hand washer and back scrubber of claim 1 wherein said combination hand washer and back scrubber includes a binding strip along the periphery of said fabric strip.

6. The combination hand washer and back scrubber of claim 1 wherein said combination hand washer and back scrubber includes a loop for hanging up said combination hand washer and back scrubber after use.

7. The combination hand washer and back scrubber of claim 1 wherein the longitudinal ends of said fabric strip are pinch-pleated.

* * * * *